US010293976B2

(12) United States Patent
Klein

(10) Patent No.: US 10,293,976 B2
(45) Date of Patent: May 21, 2019

(54) CAPPED CONTAINER MOUNTING SYSTEM WITH ENHANCED CONNECTION STRENGTH AND STABILITY

(71) Applicant: Steven Klein, Danville, CA (US)

(72) Inventor: Steven Klein, Danville, CA (US)

( * ) Notice: Subject to any disclaimer, the term of this patent is extended or adjusted under 35 U.S.C. 154(b) by 0 days.

(21) Appl. No.: 15/874,084

(22) Filed: Jan. 18, 2018

(65) Prior Publication Data

US 2018/0208361 A1 Jul. 26, 2018

Related U.S. Application Data

(60) Provisional application No. 62/450,354, filed on Jan. 25, 2017.

(51) Int. Cl.

| | |
|---|---|
| ***B65D 21/02*** | (2006.01) |
| ***B65D 81/36*** | (2006.01) |
| *A63H 33/08* | (2006.01) |

(52) U.S. Cl.

CPC ..... *B65D 21/0231* (2013.01); *B65D 21/0224* (2013.01); *B65D 81/361* (2013.01); *A63H 33/08* (2013.01)

(58) Field of Classification Search

CPC ..... B65D 21/0233; B65D 21/0234; B65D 21/0231; B65D 21/043; B65D 21/041; B65D 21/048

USPC ..... 206/503, 519, 509, 508; 220/23.83, 220/23.86; 215/10

See application file for complete search history.

(56) References Cited

U.S. PATENT DOCUMENTS

| | | | | |
|---|---|---|---|---|
| 3,374,917 A * | 3/1968 | Troy | ..... | A63H 33/08 206/504 |
| 7,175,498 B2 | 2/2007 | Garpow et al. | | |
| 7,644,828 B1 * | 1/2010 | Klein | ..... | A63H 33/067 206/509 |

(Continued)

FOREIGN PATENT DOCUMENTS

| | | |
|---|---|---|
| CN | 201224536 Y | 4/2009 |
| CN | 204056581 U | 12/2014 |

(Continued)

OTHER PUBLICATIONS

Anton Steeman, Sidel's Stack & Pack Bottle, Worldwide innovations in packaging technology—https://bestinpackaging.com/, Jun. 6, 2012.

*Primary Examiner* — J. Gregory Pickett
*Assistant Examiner* — Tia Cox
(74) *Attorney, Agent, or Firm* — Plager Schack LLP

(57) ABSTRACT

A mounting system to couple containers together includes a pair of container bodies coupled together, each container body having a bottom end connected to a top open end with a cap disposed thereon, a pair of recesses disposed in the bottom ends of the first and second container bodies, the recess of the first container body being sufficiently large to receive the cap of the second container body, the recess formed by an inner face coupled to a side wall, the side wall of the recess having a plurality of friction beam assemblies coupled thereto, each friction beam assembly in the plurality of friction beam assemblies separated from an adjacent friction beam assembly by space along the side wall of the recess. Insertion of the cap of the second container body into the recess of the first container body creates a frictional grip and a vacuum seal.

10 Claims, 4 Drawing Sheets

(56) References Cited

U.S. PATENT DOCUMENTS

| | | | | |
|---|---|---|---|---|
| 2009/0045157 | A1* | 2/2009 | Panchal | B65D 21/0204 215/10 |
| 2009/0255893 | A1* | 10/2009 | Zummo | B65D 1/0223 215/10 |
| 2009/0266782 | A1* | 10/2009 | Lane | B65D 1/023 215/10 |
| 2011/0226719 | A1* | 9/2011 | Park | B65D 21/0213 215/10 |
| 2013/0048592 | A1* | 2/2013 | Carley | B67B 7/18 215/302 |

FOREIGN PATENT DOCUMENTS

| | | | |
|---|---|---|---|
| JP | 2003-192044 | A | 7/2003 |
| KR | 2012-0001097 | U | 2/2012 |

* cited by examiner

CAPPED CONTAINER MOUNTING SYSTEM WITH ENHANCED CONNECTION STRENGTH AND STABILITY

RELATED APPLICATION

The application claims priority to provisional patent application U.S. Ser. No. 62/450,354 filed on Jan. 25, 2017, the entire contents of which is herein incorporated by reference.

BACKGROUND

The embodiments herein relate generally to coupling systems and devices for securing a plurality of plastic bottles together.

There is a tremendous amount of plastic waste in our landfills and waterways caused by empty single-serve water bottles and the bottle caps used to close them. In keeping with the principles of the Circular Economy, one way to reduce this plastic waste is to re-use empty single-serve, capped water bottles, preferably in their existing form for another purpose. For example, these empty capped single-serve bottles can be reused to construct structures for building insulation, simple structures like a bottle greenhouse, or other structures such as tables, shelves, and the like.

One way to accomplish this is to couple a plurality of capped bottles together utilizing a coupling system where the base of each bottle comprises a recess as disclosed in U.S. Pat. No. 7,644,828. The bottle cap and recess in the base share a common diameter so a connection can be achieved when the neck of a first bottle is inserted into the corresponding base recess of another bottle. There exist other bottle/containers in the field that have a blow molded recess in the base that can be used for loosely stacking the bottles/containers on top of each other such as Sidel's Stack and Pack System. However, this stacking feature is for storage purposes to stack the bottles on a pallet without the use of cardboard interlayers.

These bottle coupling systems are impractical for certain applications because they have a limited connection strength due to the loose stacking of bottles or sole reliance on a frictional grip between the cap of a bottle and recess of another bottle. Further, the frictional grip securement method of current bottle coupling systems between bottle caps and corresponding recesses in the bottle bases has fixed limits, based particularly on the diameter of the cap and the diameter of the recess. The limitation occurs when the diameter of the cap exceeds the diameter of the recess, and the coupling cannot be accomplished.

Other container/structural element coupling systems exist as disclosed in U.S. Pat. Nos. 3,374,917 and 7,175,498, which use male and female members to create frictional grip connections between containers or structural elements. Although these devices fulfill their objectives and requirements, there exists a continuing need for new and improved, non-obvious, connecting features that have the ability to enhance the connection strength and stability.

As such, there is a need in the industry for a container/bottle mounting system and apparatus to secure a plurality of bottles or containers together that addresses the limitations of the prior art. Specifically, there is a need for the mounting system and apparatus to secure empty plastic bottles or containers together with an enhanced connection strength and stability via a frictional grip and vacuum seal connection. There is a further need for the mounting system and apparatus to improve the connectivity of bottle cap to bottle recess frictional connections beyond its fixed limitation.

SUMMARY

A container mounting system for use to couple a plurality of containers together with enhanced connection stability and strength is provided. The container mounting system comprises a pair of container bodies coupled together, each container body comprising a bottom end connected to a top open end to form an internal cavity, the top open end comprising a neck portion with a cap disposed thereon, a pair of recesses disposed in the first and second container bodies, each recess disposed in one of the bottom ends in the first and second container bodies, the recess of the first container body being sufficiently large to receive the cap of the second container body, the recess formed by an inner face coupled to a side wall, the side wall of the recess comprising a plurality of friction beam assemblies coupled thereto, each friction beam assembly in the plurality of friction beam assemblies separated from an adjacent friction beam assembly in the plurality of friction beam assemblies by a gap defined by space along the side wall of the recess. Insertion of the cap of the second container body into the recess of the first container body permits the plurality of friction beam assemblies in the recess to conform to the cap. Air present within the recess of the first container body is displaced out through the gaps in the side wall of the recess between the plurality of friction beam assemblies as the cap of the second container body is fully inserted into the recess of the first container body, thereby creating a vacuum seal that secures the cap of the second container body to the recess of the first container body.

In an alternative embodiment, a container mounting apparatus to secure a first container to a second container is provided. The container mounting apparatus comprises a sleeve comprising a top open end, a bottom end opposite the top open end, and a side wall connecting the top open end to the bottom end to create an internal cavity configured to receive the bottom end of the first container, the bottom end of the sleeve comprising a recess sufficiently large to receive the cap of the second container, the recess formed by an inner face coupled to a side wall, the side wall of the recess comprising a plurality of friction beam assemblies coupled thereto, each friction beam assembly in the plurality of friction beam assemblies separated from an adjacent friction beam assembly in the plurality of friction beam assemblies by a gap defined by space along the side wall of the recess.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1A:
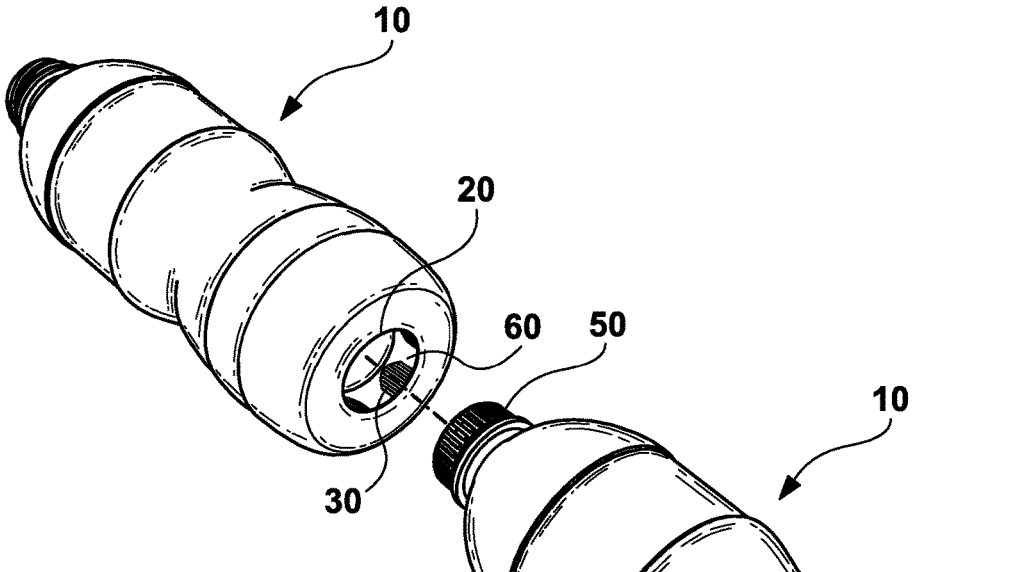
FIG. 1A depicts a perspective view of certain embodiments of the container mounting system.
Figure 1B:
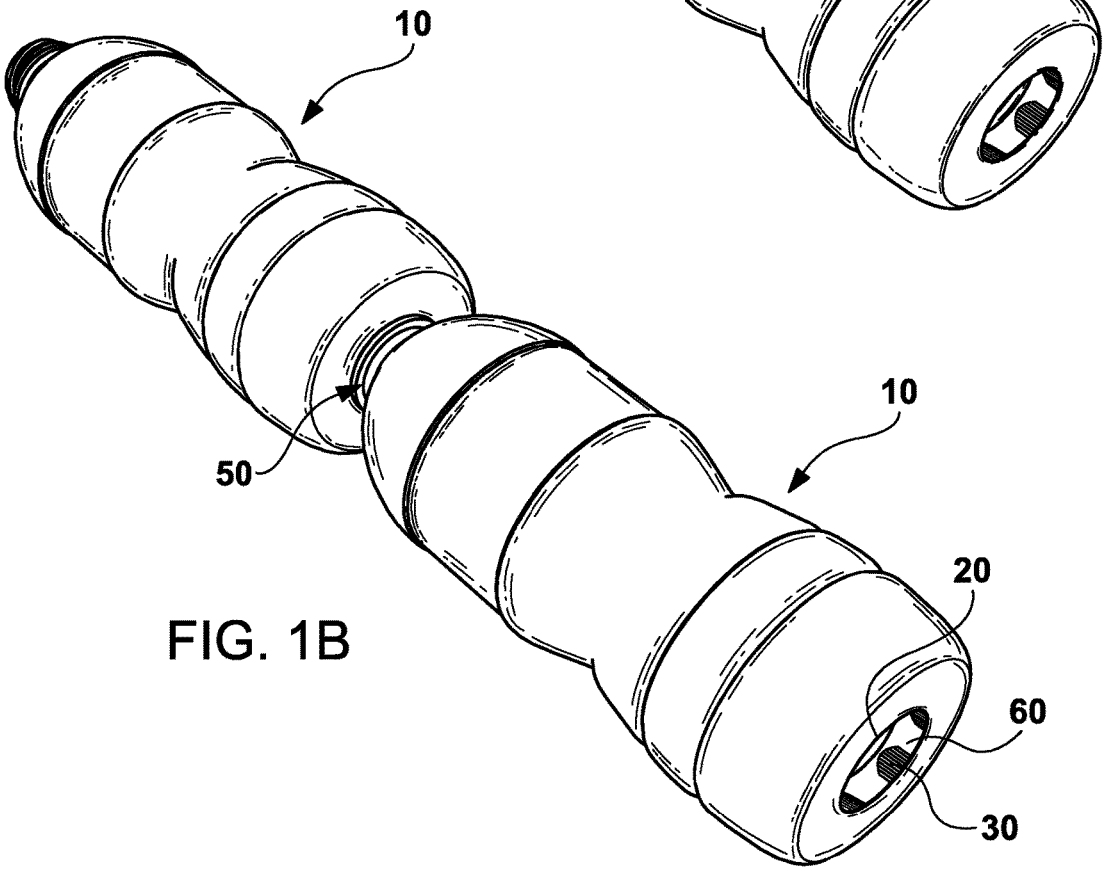
FIG. 1B depicts a perspective view of certain embodiments of the container mounting system shown in use.
Figure 2A:
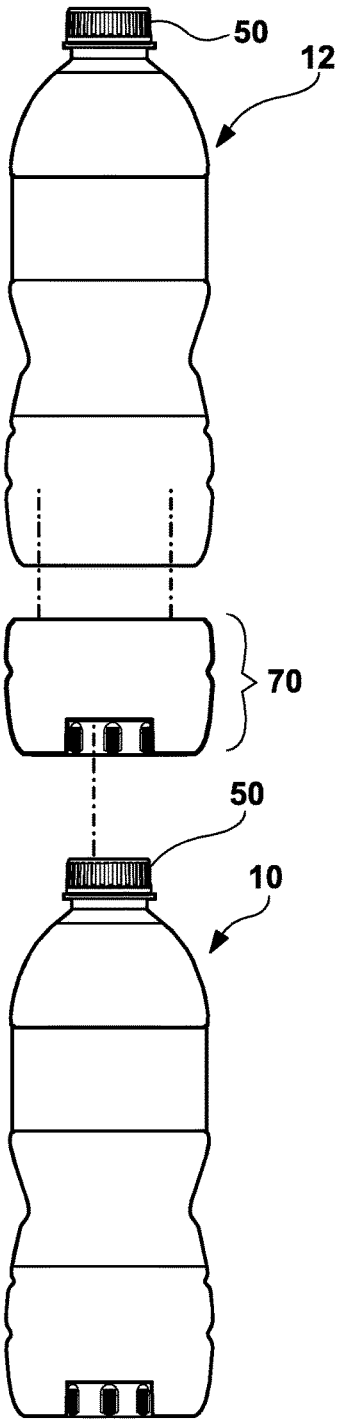
FIG. 2A depicts a side exploded view of certain embodiments of the container mounting apparatus.
Figure 2B:
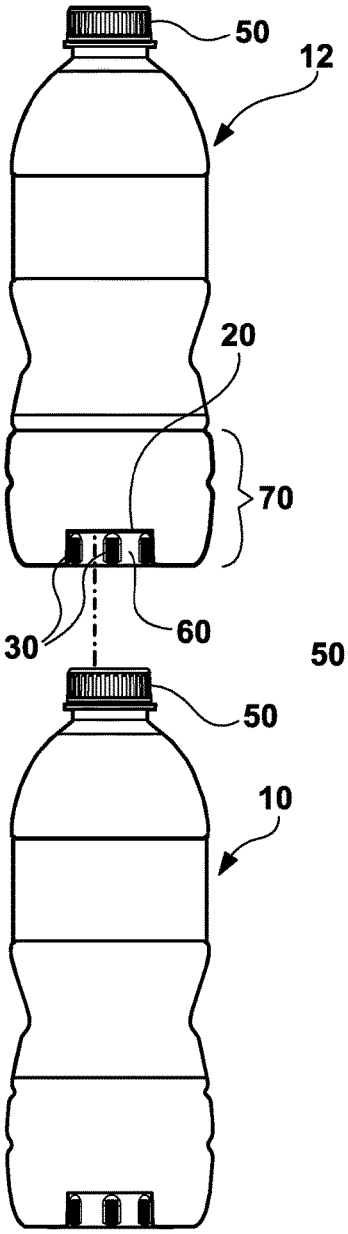
FIG. 2B depicts a side view of certain embodiments of the container mounting apparatus shown in use.

As depicted in FIGS. 1-3, the mounting system and apparatus are configured to secure containers together with enhanced connection strength and stability by using both a frictional grip and vacuum seal. The containers are preferably empty plastic bottles depicted by first exemplary bottles 10 and second exemplary bottles 12. First exemplary bottles 10 and second exemplary bottles 12 are commonly available empty plastic bottles known in the field, which are typically used to store drinking water. Each bottle in first and second exemplary bottles 10, 12 comprises a bottom end, a top open end connected to the bottom end by a side wall to create an internal cavity, and cap 50 disposed on a neck portion present on the top open end.

In one embodiment, each bottle in first and second exemplary bottles 10, 12 is configured to store approximately 16.9 fluid ounces and has an approximate height of 8" and diameter of 2.5". In an alternative embodiment, each bottle in first and second exemplary bottles 10, 12 is configured to store approximately 12 fluid ounces and has an approximate height of 7" and diameter of 2.25". In an alternative embodiment, each bottle in first and second exemplary bottles 10, 12 is configured to store approximately 8 fluid ounces and has an approximate height of 5" and diameter of 2.25". In one embodiment, cap 50 comprises a diameter of approximately 1.10" (28 millimeters) with a variable height. However, it shall be appreciated that the dimensions of each bottle may vary.

In a preferred embodiment, first and second exemplary bottles 10, 12 are made from flexible PET plastic, which permits portions of the bottle to deform. In one embodiment, the flexible plastic used in first and second exemplary bottles 10, 12 means that a force of up to 25 pounds applied axially at a midpoint of the side wall of the bottle will cause first and second exemplary bottles 10, 12 to deform within the approximate range of 0"-2".

Figure 3A:
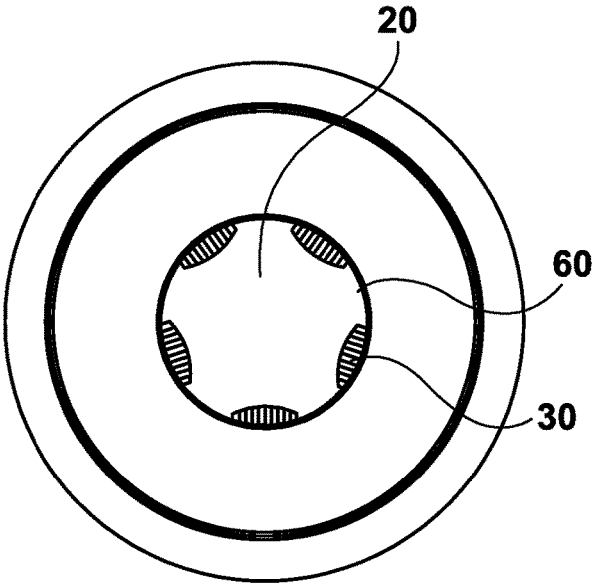
FIG. 3A depicts a bottom view of certain embodiments of the container mounting apparatus and system.
Figure 3B:
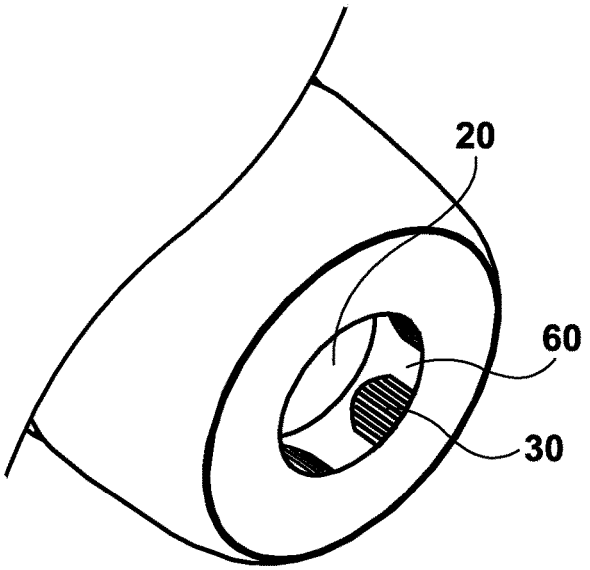
FIG. 3B depicts a perspective view of certain embodiments of the container mounting apparatus and system.

As depicted in FIGS. 1 and 3, the mounting system generally comprises a plurality of first exemplary bottles 10 with the bottom end of each first exemplary bottle 10 comprising recess 20 and a plurality of friction beam assemblies 40 coupled to a side wall of each recess 20, wherein each friction beam assembly comprises micro-rib beam set 30. As depicted in FIGS. 3A-3B, recess 20 is disposed in the bottom of first exemplary bottle 10 and is sufficiently large to entirely receive cap 50 of another bottle. Recess 20 is a generally cylindrical cutout with an inner face coupled to a side wall that tightly conforms to cap 50 when inserted therein.

In one embodiment, a plurality of friction beam assemblies 40 comprising micro-rib beam sets 30 are coupled along the side wall of recess 20 and oriented generally parallel to a longitudinal axis of first exemplary bottle 10. Each micro-rib beam set 30 is separated from an adjacent micro-rib beam set 30 by gap 60 defined by space along the side wall of recess 20. In a preferred embodiment, the size of gaps 60 between micro-rib beam sets 30 are equal to each other. However, the size of gaps 60 may vary from each other in recess 20.

Figure 3C:
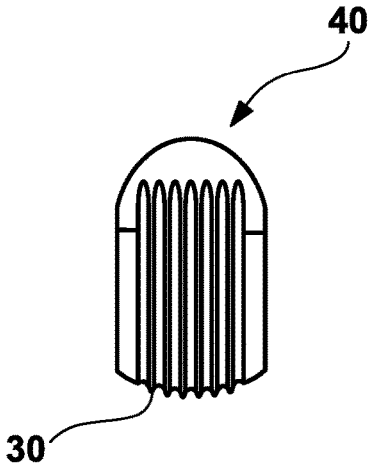
FIG. 3C depicts a front view of certain embodiments of the container mounting apparatus.
Figure 4A:
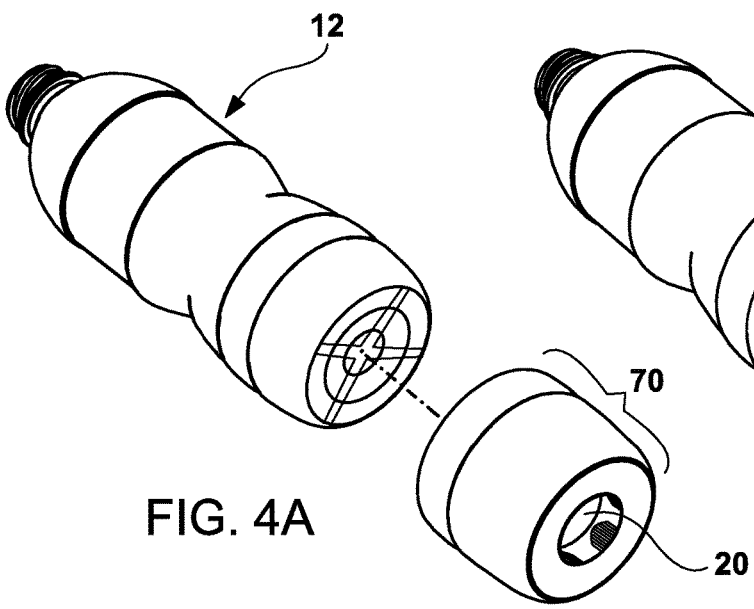
FIG. 4A depicts a perspective exploded view of certain embodiments of the container mounting apparatus.
Figure 4B:
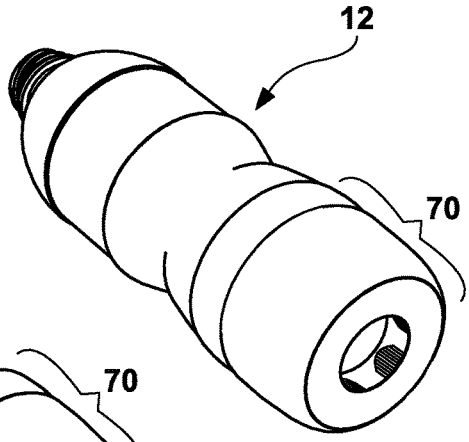
FIG. 4B depicts a perspective view of certain embodiments of the container mounting apparatus shown in use.
Figure 5A:
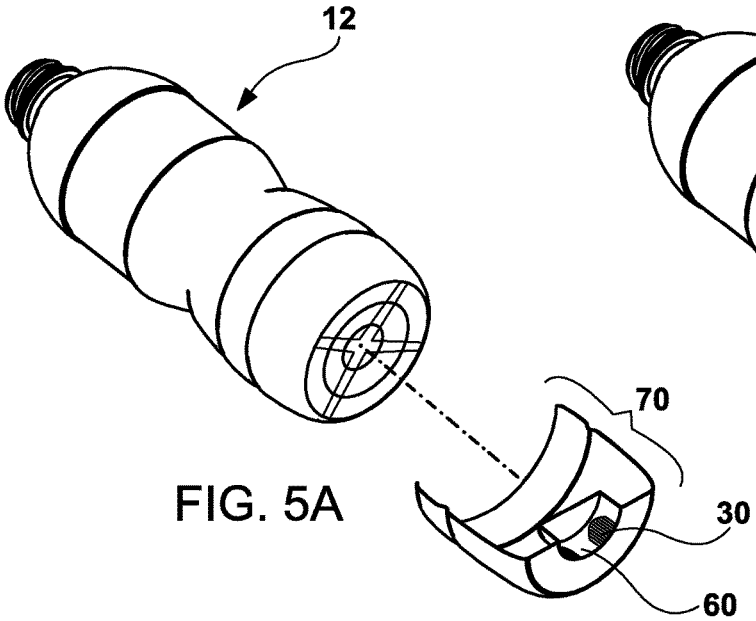
FIG. 5A depicts a perspective exploded view of certain embodiments of the container mounting apparatus illustrating certain components in a cutaway view.
Figure 5B:
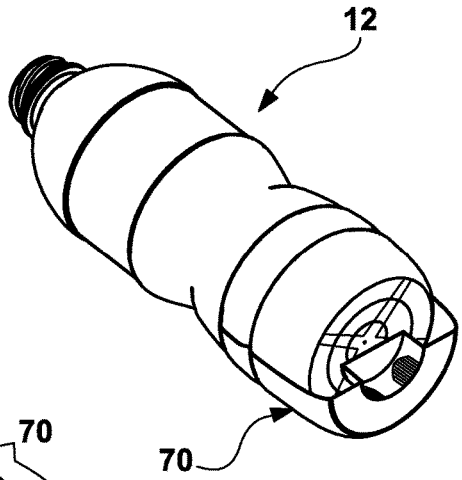
FIG. 5B depicts a perspective view of certain embodiments of the container mounting apparatus shown in use and illustrating certain components in a cutaway view.

FIG. 3C depicts an exemplary friction beam assembly 40 comprising a plurality of flexible micro-ribs arranged generally parallel to each other to form micro-rib beam set 30. In one embodiment, micro-rib beam sets 30 are preferably made from the same material as first exemplary bottle 10. However, alternative materials may be used to form micro-rib beam sets 30. In one embodiment, the plurality of micro-ribs comprise the same length. In an alternative embodiment, the length of the plurality of micro-ribs in each micro-rib beam set 30 may vary. This is illustrated in FIG. 3B where the micro-rib length increases from the outer micro-ribs to the intermediate micro-ribs in micro-rib beam set 30. As depicted in FIG. 3A, recess 20 preferably comprises five micro-rib beam sets 30. However, the number of micro-rib beam sets 30 in recess 20 may vary.

In operation, a plurality of first exemplary bottles 10 are coupled together as shown in FIG. 1. Cap 50 of first exemplary bottle 10 is inserted into recess 20 of another first exemplary bottle 10. As cap 50 is pressed into recess 20, the flexible micro-rib beam sets 30 begin to tightly conform to the exterior side wall of cap 50. This creates a frictional grip connection between recess 20 and cap 50 that gradually strengthens up to the stage where cap 50 is inserted approximately ⅔ of the way into recess 20. During this process, air present within recess 20 is displaced out through gaps 60 in the side wall of recess 20 as cap 50 is pressed in. As such, gaps 60 serve as passageways to permit air to escape out of recess 20. Once cap 50 is fully inserted within recess 20, all of the air in recess 20 is displaced and an audible click is generated. This indicates a complete frictional grip and vacuum seal connection has been achieved between the connected first exemplary bottles 10. In this position, cap 50 is in contact with the inner face of recess 20. To detach the connected bottles, first exemplary bottles 10 are pulled apart from each other.

In an alternative embodiment, a mounting apparatus is provided to connect a plurality of second exemplary bottles 12 together as depicted in FIGS. 2-5. Second exemplary bottles 12 are plastic bottles without recesses on the bottom ends, which are readily available on the market. The mounting apparatus generally comprises sleeve 70, which comprises a bottom end connected to a top open end by a side wall to create an internal cavity. Sleeve 70 is made from plastic, rubber, or any alternative material known in the field. The bottom end of sleeve 70 comprises recess 20 and micro-rib beam sets 30, which are identical to those described in other embodiments of the invention.

Figure 2C:
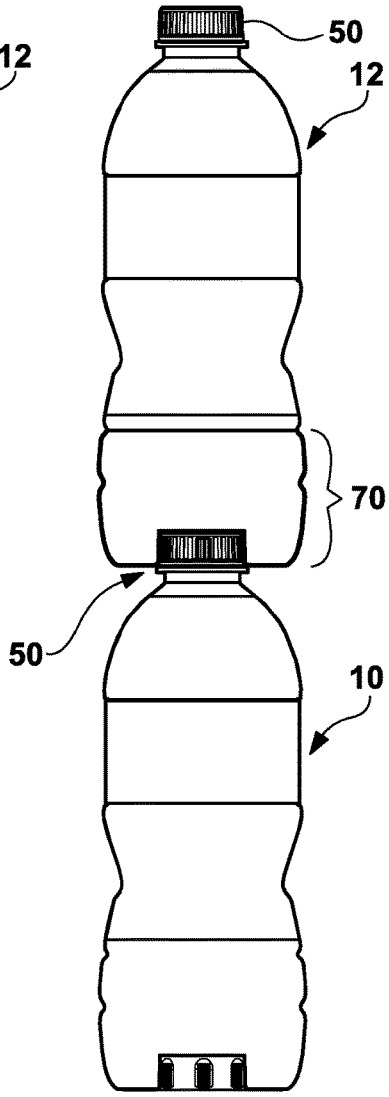
FIG. 2C depicts a side view of certain embodiments of the container mounting apparatus shown in use.

As depicted in FIGS. 2A-2B and 4-5, sleeve 70 is disposed around second exemplary bottle 12 with the bottom end of the bottle inserted into the internal cavity of sleeve 70. This creates a frictional grip connection between sleeve 70 and second exemplary bottle 12. As depicted in FIG. 2C, cap 50 of another second exemplary bottle 12 is inserted into recess 20 of sleeve 70. As such, sleeve 70 serves as an adapter that connects second exemplary bottles 12 together.

It shall be appreciated that the mounting system and apparatus may be used to connect any number of first and second exemplary bottles 10, 12 together. Connector members can be used in conjunction with the mounting system and/or apparatus to vary the angles of the bottles relative to other connected bottles in the set. As such, the mounting system and apparatus permits the user to construct a wide range of structures including, but not limited to, building insulation members, a bottle greenhouse, or other structures such as tables, shelves, and the like. The mounting system and apparatus enhance the connection strength and stability between bottles, and permits the constructed structures to support greater loads.

It shall be appreciated that the components of the mounting system and apparatus described in several embodiments herein may comprise any alternative known materials in the field and be of any color, size and/or dimensions. It shall be appreciated that the components of the mounting system and apparatus described herein may be manufactured and assembled using any known techniques in the field. In one embodiment, recesses 20 and friction beam assemblies 40 may be incorporated into plastic bottles using a high-speed blow molding machine. Components such as sleeve 70 may be manufactured using an injection mold process.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A container mounting system for use to couple a plurality of containers together with enhanced connection stability and strength, the container mounting system comprising:

a pair of container bodies coupled together, each container body in the pair of container bodies comprising a bottom end connected to a top open end to form an internal cavity, the top open end comprising a neck portion with a cap disposed thereon;

a pair of recesses disposed in the first and second container bodies, each recess in the pair of recesses disposed in one of the bottom ends in the first and second container bodies, the recess of the first container body being sufficiently large to receive the cap of the second container body, the recess formed by an inner face coupled to a side wall, the side wall of the recess comprising a plurality of friction beam assemblies coupled thereto, each friction beam assembly in the plurality of friction beam assemblies separated from an adjacent friction beam assembly in the plurality of friction beam assemblies by a gap defined by space along the side wall of the recess;

wherein insertion of the cap of the second container body into the recess of the first container body permits the plurality of friction beam assemblies in the recess to conform to the cap, wherein air present within the recess of the first container body is displaced out through the gaps in the side wall of the recess between the plurality of friction beam assemblies as the cap of the second container body is fully inserted into the recess of the first container body, thereby creating a vacuum seal that secures the cap of the second container body to the recess of the first container body.

2. The container mounting system of claim 1, wherein each friction beam assembly in the plurality of friction beam assemblies comprises a plurality of ribs disposed on the side wall of the recess, the plurality of ribs configured to conform to the cap as the cap of the second container body is inserted into the recess of the first container body.

3. The container mounting system of claim 2, wherein the plurality of ribs of the friction beam assembly in the plurality of friction beam assemblies are oriented generally parallel to each other.

4. The container mounting system of claim 3, wherein the plurality of ribs of the friction beam assembly in the plurality of friction beam assemblies comprises a length that increases from outer ribs in the plurality of ribs of the friction beam assembly to intermediate ribs in the plurality of ribs of the friction beam assembly.

5. The container mounting system of claim 4, wherein the plurality of gaps between the plurality of friction beam assemblies are equal in size.

6. A container mounting apparatus for use to secure a first container to a second container with enhanced connection stability and strength, each container in the first and second containers comprising a bottom end connected to a top open end to form an internal cavity, the top open end comprising a neck portion with a cap disposed thereon, the container mounting apparatus comprising:

a sleeve comprising a top open end, a bottom end opposite the top open end, and a side wall connecting the top open end to the bottom end to create an internal cavity configured to receive the bottom end of the first container, the bottom end of the sleeve comprising a recess sufficiently large to receive the cap of the second container, the recess formed by an inner face coupled to a side wall, the side wall of the recess comprising a plurality of friction beam assemblies coupled thereto, each friction beam assembly in the plurality of friction beam assemblies separated from an adjacent friction beam assembly in the plurality of friction beam assemblies by a gap defined by space along the side wall of the recess;

wherein insertion of the cap of the second container into the recess of the sleeve permits the plurality of friction beam assemblies to conform to the cap, wherein air present within the recess of the sleeve is displaced out through the gaps in the side wall of the recess between the plurality of friction beam assemblies as the cap of the second container is fully inserted into the recess of the sleeve, thereby creating a vacuum seal that secures the cap of the second container to the recess of the sleeve.

7. The container mounting apparatus of claim 6, wherein each friction beam assembly in the plurality of friction beam assemblies comprises a plurality of ribs disposed on the side wall of the recess of the sleeve, the plurality of ribs configured to conform to the cap as the cap of the second container is inserted into the recess of the sleeve.

8. The container mounting apparatus of claim 7, wherein the plurality of ribs of the friction beam assembly in the plurality of friction beam assemblies are oriented generally parallel to each other.

9. The container mounting apparatus of claim 8, wherein the plurality of ribs of the friction beam assembly in the plurality of friction beam assemblies comprises a length that increases from outer ribs in the plurality of ribs of the friction beam assembly to intermediate ribs in the plurality of ribs of the friction beam assembly.

10. The container mounting apparatus of claim 9, wherein the plurality of gaps between the plurality of friction beam assemblies are equal in size.

* * * * *